US005794419A

United States Patent [19]

Cohen

[11] Patent Number: 5,794,419

[45] Date of Patent: Aug. 18, 1998

[54] EQUESTRIAN STIRRUP IRON

[76] Inventor: Martin D. Cohen, 122 Monterey Ave., Pacific Grove, Calif. 93950

[21] Appl. No.: 621,014

[22] Filed: Mar. 22, 1996

[51] Int. Cl.[6] ..... B68C 3/00

[52] U.S. Cl. ..... 54/47

[58] Field of Search ..... 54/47, 48, 49.5

[56] References Cited

U.S. PATENT DOCUMENTS

| | | | |
|---|---|---|---|
| D. 47,024 | 3/1915 | Buermann . | |
| 169,209 | 9/1875 | Wagstaff . | |
| D. 222,556 | 11/1971 | Whitman . | |
| 608,605 | 8/1898 | House | 54/47 |
| 706,468 | 8/1902 | Wellman | 54/47 |
| 746,126 | 12/1903 | Myers | 54/48 |
| 1,174,712 | 3/1916 | Gunn | 54/47 |
| 1,639,073 | 8/1927 | Berbaum . | |
| 2,532,082 | 11/1950 | Borst | 54/47 |
| 3,816,974 | 6/1974 | Erickson | 54/49 |
| 3,927,509 | 12/1975 | Riebold | 54/48 |
| 5,172,538 | 12/1992 | Luger | 54/47 |
| 5,598,687 | 2/1997 | Hester | 54/47 |

FOREIGN PATENT DOCUMENTS 339248 12/1903 France .

*Primary Examiner*—Robert P. Swiatek

*Attorney, Agent, or Firm*—Townsend and Townsend and Crew LLP

[57] ABSTRACT

An equestrian stirrup iron that swivels with respect to the stirrup leather so that in preparation for riding, the rider may bring the stirrup iron down from the run up position, pivot it to a desired angle in the generally forward direction, and insert his or her foot therein. A cylindrical swivel base is fastened to the top of the arch of the swivel iron. A cylindrical swivel body is rotatably mounted to the swivel base. A member having a stirrup leather opening is attached to the swivel body. The swivel body may be rotatably secured to the swivel base by a threaded fastener or by a welded shank or pin. A spring-loaded ball in the swivel base cooperates with a plurality of detent cones disposed in the swivel body. In another version, a spring-loaded friction member disposed in the swivel base cooperates with a friction disk mounted on the lower surface of the swivel body to provide smoothly variable angular increments of rotation. The swivel base can be moved down into the top of the arch to drop the silhouette of the stirrup iron.

4 Claims, 6 Drawing Sheets

EQUESTRIAN STIRRUP IRON

TECHNICAL FIELD

The present invention relates to an improved stirrup iron for equestrian use which can be oriented so that the rider can select a number of varying angles that allow him/her to engage the stirrup iron in its most comfortable and accessible manner, thus providing an improved utilization of the stirrup iron for the rider's particular riding style, personal conformation, and safety.

BACKGROUND ART

When horses began to be used for domestic purposes, they were first employed for draft. However, it soon became apparent that horses could be utilized for riding. The saddle was developed and evolved from at least as early as 2000 years BC. In order to enhance control of the horse, the saddles were developed with a wooden internal frame or tree. This gives shape to the seat as well as generally defines the underside contact of the saddle on the horse's back. The saddle tree is padded and covered. The greatest advance in security of rider on horse was the invention of the stirrup, which came into evidence about 550 AD. The original stirrup was a looped leather strap which was attached to the saddle tree. The lower opening of the loop received the foot. There are many advantages to the use of the stirrup, most of which relate to the comfort and security of the rider.

The stirrup iron was soon developed. The stirrup iron is a generally D-shaped structure with a foot opening therethrough. Above the foot opening is an elongated opening for receiving a stirrup strap or leather. In regard to terminology, "stirrup leather" is a generally accepted term in the equestrian community. The meaning of the term is a leather strap which connects the stirrup iron to the saddle at a stirrup bar. It will be understood that the upper end of the stirrup leather connects to the stirrup bar, while the lower end of the stirrup leather passes through the elongated opening to support the stirrup iron. The stirrup bar is integrated into the saddle itself, and is generally affixed to the saddle slightly behind and below the saddle's pommel. The stirrup bar is oriented generally fore and aft with respect to the saddle and, thus, the stirrup leather lies against the saddle flap with the width direction of the leather being oriented generally fore and aft with respect to the saddle.

When the horse is not being ridden, the stirrup iron is normally in a resting or "run up" position. In preparation for riding, the stirrup iron is brought down from the run up position, and the stirrup iron hangs at the end of the stirrup leather with an orientation parallel to the horse. This is not the position the rider needs to ride the horse. The rider requires that the stirrup iron be turned at an angle to meet riding style needs, comfort needs, and a certain amount of safety. Thus, there is a need for a stirrup iron that provides a variety of selectable angles to fulfill the immediate need of the equestrian to turn his/her stirrup irons into a more forward position. Should the rider accidentally lose the stirrup position, and his/her foot become disengaged from the stirrup, it would be desirable for the stirrup iron to retain its selected angle so that it can be easily and predictably positioned for the rider's retrieval of the stirrup iron. It is an object of the present invention, therefore, to provide an improvement in the rider's foot position, and to provide enhanced personal comfort and safety while maintaining the rider's feet in the stirrup irons.

DISCLOSURE OF INVENTION

In accordance with these and other features of the improved stirrup iron of the present invention, there is provided a generally D-shaped stirrup iron with an opening sized to receive the rider's foot. Above the foot opening is a member having a stirrup leather opening to receive the stirrup leather. The member having the stirrup leather opening is pivoted on a generally vertical axis with respect to the stirrup iron so that the stirrup iron can have the foot opening turned to be accessible and open in the generally front-to-back direction. The pivotability of the member having the stirrup leather opening permits the stirrup iron to hang at a selected orientation beneath the stirrup leather opening.

Other features of the present invention are disclosed or apparent in the section entitled "BEST MODE FOR CARRYING OUT THE INVENTION."

BRIEF DESCRIPTION OF THE DRAWINGS

For a fuller understanding of the present invention, reference is made to the accompanying drawings taken in conjunction with the following detailed description of the Best Mode For Carrying Out The Invention. In the drawing.

Figure 3:
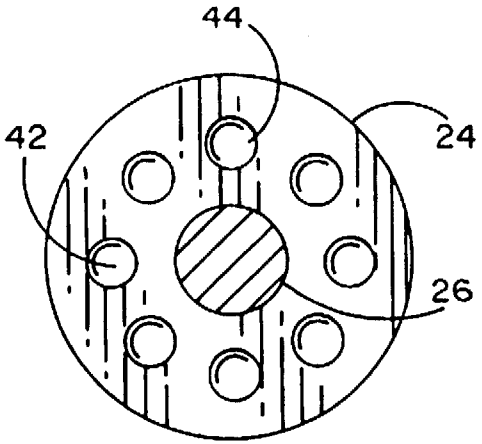
FIG. 3 is a further enlarged view looking upward, generally along the line 3—3 of FIGS. 1 and 2.

Reference numbers refer to the same or equivalent parts of the present invention throughout the several figures of the drawing.

BEST MODE FOR CARRYING OUT THE INVENTION

Figure 1:
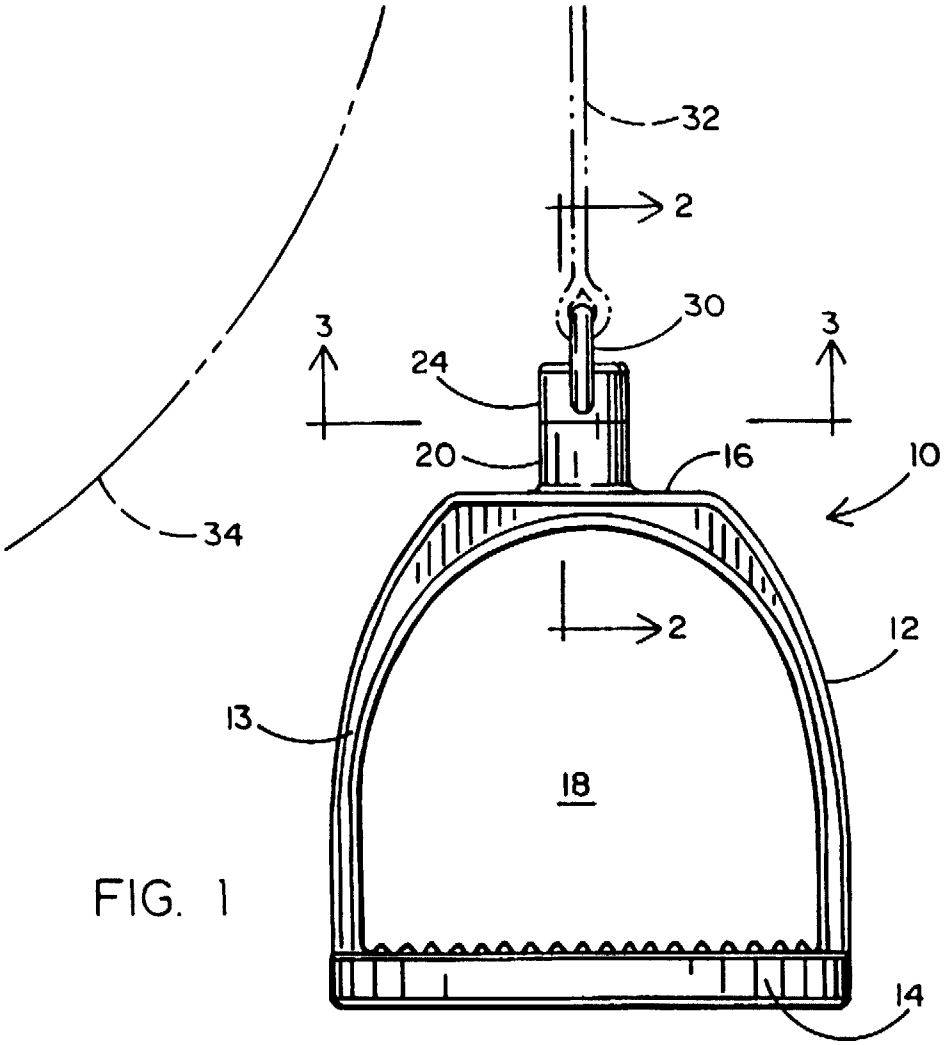
FIG. 1 is a front-elevational view of the improved stirrup iron of this invention, with the stirrup leather and side of the horse shown in dot-dash lines.
Figure 2:
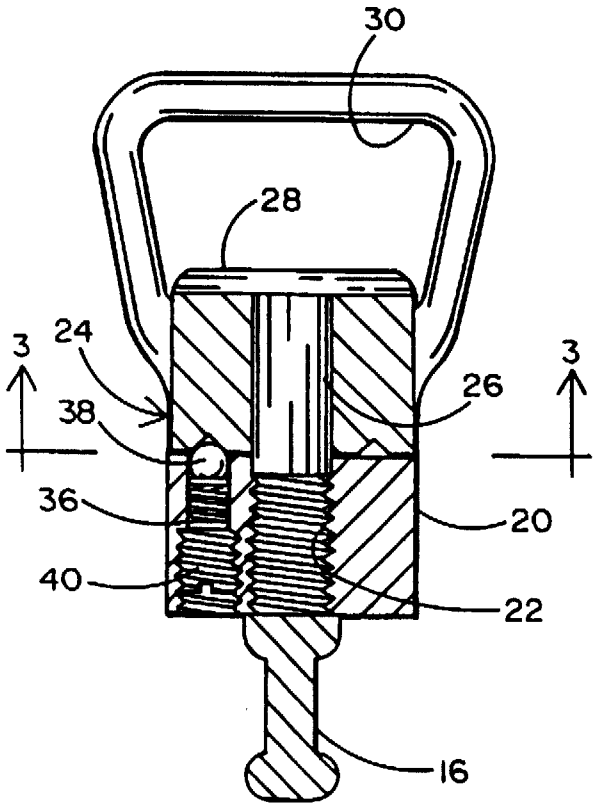
FIG. 2 is an enlarged sectional view of the top portion of a first preferred embodiment of the stirrup iron, as seen generally along the line 2—2 of FIG. 1, showing the upper portion of the stirrup iron and the manner in which the stirrup leather opening is pivoted thereon.

The improved stirrup iron of this invention is generally indicated at 10 in FIG. 1. The stirrup iron 10 comprises two side members 12, 13 together forming an arch lying in a single plane. The top of the arch is identified by reference numeral 16. The stirrup iron 10 is generally D-shaped, lying on its back. The D-shape includes a foot bar 14, which with the arch formed by the side members 12, 13, define an opening 18 through which the foot can be inserted. The top of the arch 16 of the stirrup iron 10 has a swivel base 20 attached thereto. As seen in FIG. 2, the swivel base 20 may have a threaded opening 22 generally centrally located in upright position therein.

A swivel body 24 is positioned above the swivel base 20. By way of illustration, but not limitation, pivoting action is provided by a bolt 26 that extends downward through a corresponding clearance hole in swivel body 24 and is threaded into the threaded opening 22. It will be understood that ball bearings may be provided in the swivel body 24, if desired, to provide a smoother pivoting action than can be achieved by employing the clearance hole as a journal bearing for the bolt 26.

The top of the bolt 26 carries bolt head 28. Attached to the swivel body 24 is a member defining a stirrup leather opening 30. The member defining the stirrup leather opening 30 is secured to the swivel body 24 and extends sufficiently above bolt head 28 so that a stirrup leather can be received through the stirrup leather opening 30. FIG. 1 shows stirrup leather 32 in dashed lines engaging through the stirrup leather opening 30.

It is conventional in saddle construction to provide the saddle with a saddle tree, and the saddle tree has a stirrup bar therein oriented generally in the front-to-back direction. The stirrup leather 32 engages over the stirrup bar and, thus, lies flat and parallel with respect to the side of the horse 34, also shown in dashed lines in FIG. 1. This also positions the stirrup leather opening 30 with its top also parallel to the side of the horse.

In conventional practice, this would put the stirrup iron 10 lying generally parallel to the side of the horse. However, in the present invention, the stirrup iron 10 can rotate on a vertical axis with respect to the stirrup leather opening 30. This permits the stirrup iron 10 to lie so that the rider's foot may be directly entered into its opening 18.

Figure 4:
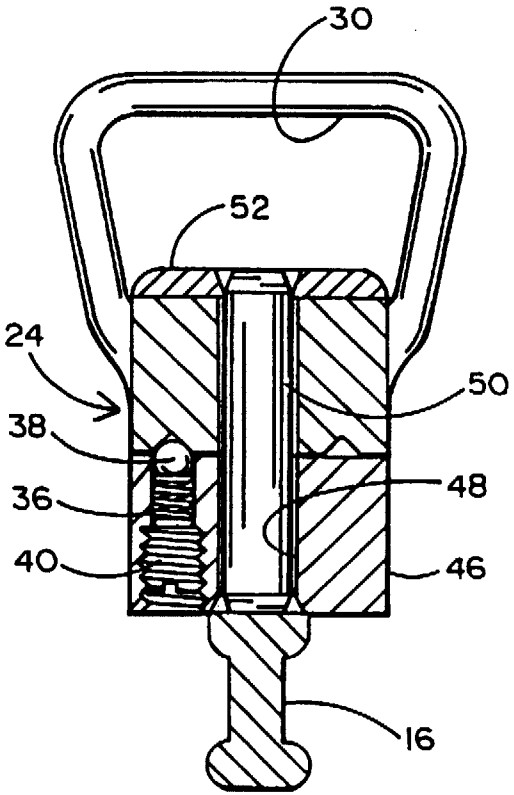
FIG. 4 is a view similar to FIG. 2, showing a second preferred embodiment of the stirrup iron of this invention.

It is critical to this invention that the stirrup leather opening 30 be rotatable on a generally vertical axis with respect to the stirrup iron 10. This can be accomplished by other types of construction, such as the second preferred embodiment of the improved equestrian stirrup iron of this invention, as is seen in FIG. 4. In this embodiment, the swivel body 24, with its stirrup leather opening 30, is the same as shown in FIG. 2. By way of illustration, but not limitation, pivoting action is provided by a pin 50. The swivel base 46 is very much the same as swivel base 20 and includes the same detent structure. However, instead of internal threads, the swivel base 46 has an internal cylindrical opening 48 which receives pin 50. Head 52 is attached to the top of the pin 50, as by welding. Similarly, the pin 50 is secured in the bottom of swivel base 46 such as by welding. The swivel base in both FIGS. 2 and 4 is attached to the top of the arch 16 of the stirrup iron 10, such as by welding. This structure permits the swivel body 24 to rotate on the vertical axis of pin 50 and to be retained thereon by head 52.

It will be understood that the weight of the rider is borne by the stirrup irons and thus it is necessary that all of the parts of the stirrup iron assembly remain integrally assembled together. As illustrated in FIGS. 2 and 4, there are many ways of providing the pivoting action, and it is not intended to limit the invention to the examples illustrated in FIGS. 2 and 4.

In order to maintain the selected rotational position of the stirrup iron 10 under the stirrup leather opening 30, a detent structure is provided. Swivel bases 20 and 46 each have a detent bore 36 which contains a spring. The bore 36 has ball 38 in its top. The ball 38 is held up by means of a spring which is contained on its underside by screw 40 being engaged in the threaded portion of the bore. The screw 40 can be removed for spring and ball replacement and can be tightened on the spring for detent pressure adjustment. The ball 38 engages in detent cones on the underside of swivel body 24. Detent cone 42 is specifically identified in FIG. 3 and is also seen in FIGS. 2 and 4 as being engaged by the ball 38. By way of illustration, but not limitation, FIG. 3 illustrates eight such detent cones arranged at a uniform radius and at 45 degrees with respect to each other. Thus, the stirrup iron can be rotated and held by the detent in any 45 degree position of the stirrup leather opening 30 with respect to the stirrup iron 10. The detent cone positions can be selected as required. However, the detent cone positions should include one at the position of detent cone 42, which holds the stirrup iron parallel to the stirrup leather opening 30, and one at the position of detent cone 44 where the swivel body is detented at a position where the stirrup iron 10 is at a 90 degree angle with respect to the stirrup leather opening 30, as shown in FIG. 1.

Although the stirrup iron of the present invention has been shown with eight detent cones, this is by way of example only, and more or less detent cones may be used, if desired. Three or five detent cones may be used, if desired. Also, angular increments of 45 degrees have been shown by way of example. It will be understood that the detent cones can be arranged at any angle or angular increments found convenient for the rider, for example 22.5 degrees.

Figure 5:
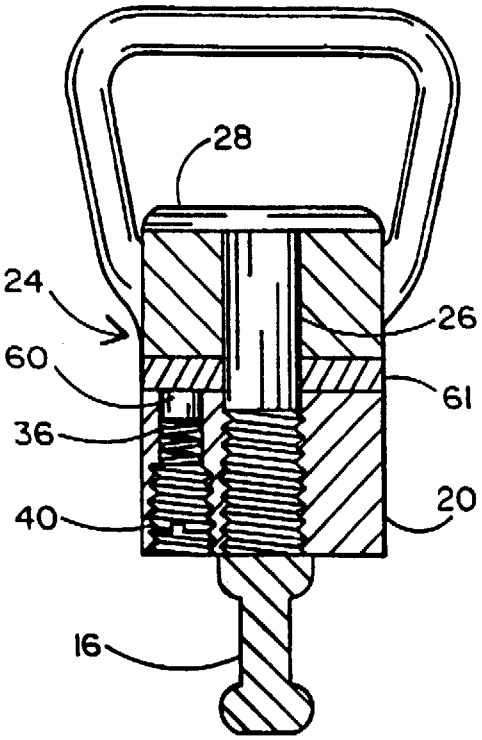
FIG. 5 is a cross-sectional side view of the top portion of another version of the stirrup iron of the present invention.

By way of illustration, but not limitation, the detent structure is shown as employing a spring-loaded ball that cooperates with detent cones. It will be understood that other mechanical detent arrangements may be used in accordance with the present invention. For example, an internal or external bayonet-type lock using pin recesses in the swivel body 24, or mutually engagable irregular surfaces on the swivel base 20 and swivel body 24 along with a spring on the pivot. It is also possible to use concentric cylinders having a locking pin transverse to the central axis that engages detent openings radially disposed around the periphery of the inner cylindrical swivel body 24. Furthermore, it is not necessary that the pivoting action be limited to predetermined angular positions. FIG. 5 illustrates a version of the improved equestrian stirrup iron that provides non-detenting pivoting action. FIG. 5 corresponds generally to the version of FIG. 2 except for the smoothly variable angular adjustment. The top of the arch 16 of the stirrup iron has a swivel base 20 attached thereto. A swivel body 24 is positioned above the swivel base 20. Attached to the swivel body 24 is a member defining a stirrup leather opening 30. The member defining the stirrup leather opening 30 is secured to the swivel body 24.

In order to maintain the selected rotational position of the stirrup iron, a frictional or braking structure is provided. Swivel base 20 has a bore 36 which contains a spring. The bore 36 has a generally cylindrical friction member 60 in its top. The friction member 60 is held up by means of a spring which is contained on its underside by screw 40 being engaged in the threaded portion of the bore 36. The screw 40 can be removed for replacement of the spring and friction member 60, and can be tightened on the spring for pressure adjustment. The friction member 60 engages a friction disk 61 fastened on the underside of swivel body 24. The friction member 60 and the friction disk 61 are made of a material having a high coefficient of friction.

Figure 10:
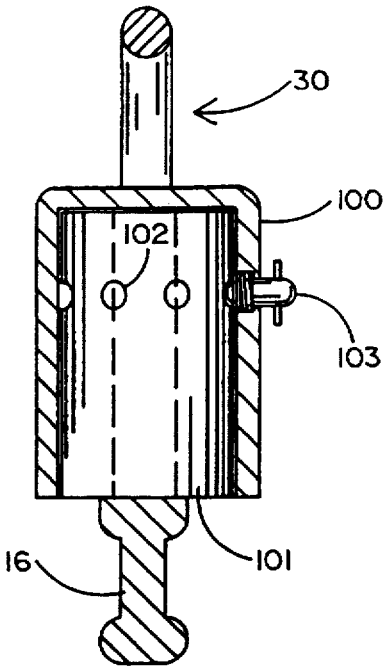
FIG. 10 is a side view partly in cross section of another version of the stirrup iron having a radial locking pin.

FIG. 10 illustrates a version of the stirrup iron having the swivel body 100 formed as a hollow cylinder extending down over the swivel base 101. The swivel base 101 is provided with a plurality of locking holes 102 disposed radially around the periphery thereof. A spring loaded locking pin 103 is disposed in the wall of the swivel body 100 and is spring loaded for locking the swivel body 100 to the swivel base 101. In operation, the locking pin 103 is withdrawn with the fingers and the member having the stirrup leather opening 30 is rotated with respect to the stirrup iron, after which the locking pin 103 is released to enter one of the locking holes 102.

Figure 11:
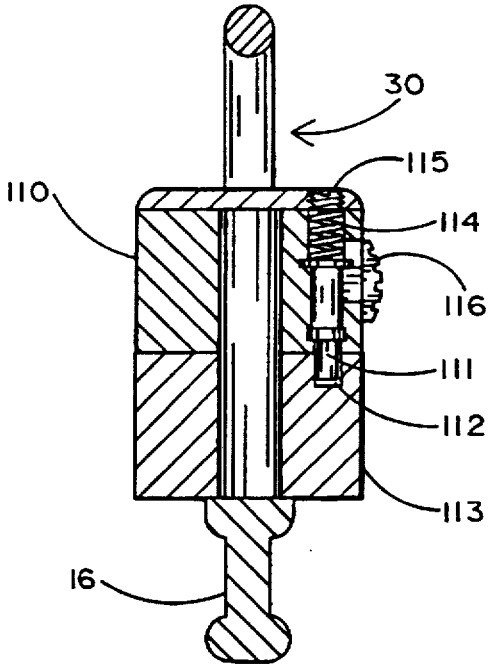
FIG. 11 is a side view partly in cross section of yet another version of the stirrup iron having a locking pin whose axis is parallel to the central axis and which locks into the swivel base.

FIG. 11 illustrates a version of the stirrup iron having the swivel body 110 provided with a locking pin 111 which is parallel to the central axis of the stirrup iron. The locking pin 111 fits into a blind hole 112 disposed in the swivel base 113. There is a spring 114 that applies pressure to the locking pin 111, and a screw 115 is provided to adjust the spring pressure. A thumb release latch 116 is coupled to the locking pin 111. In operation, the thumb release latch 116 is moved in an upward direction to remove the locking pin 111 from the blind hole 112. Then the member defining the stirrup leather opening 30 is rotated to a desired angular position, following which the thumb release latch 116 is lowered to insert the locking pin 111 in a blind hole 112.

Figure 12:
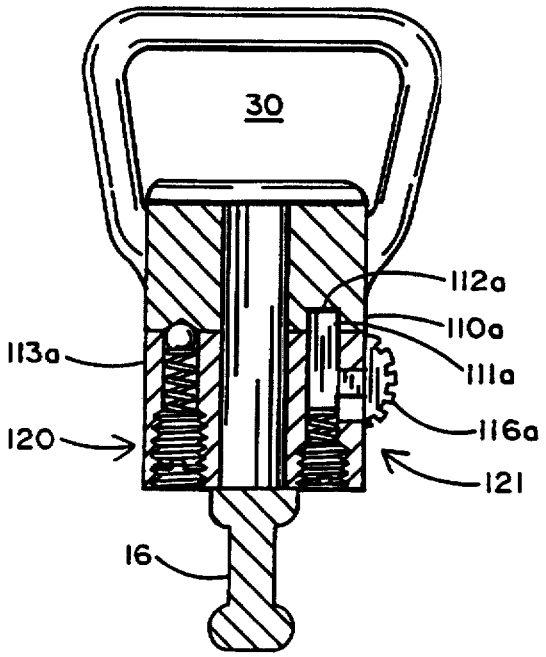
FIG. 12 is a side view partly in cross section of a further version of the stirrup iron having a locking pin as well as a ball detent mechanism, this locking pin being parallel to the central axis and which locks into the swivel body.

Referring now to FIG. 12, there is shown a version of the stirrup iron of the present invention which is provided with a ball detent mechanism 120 as well as a lock pin mechanism 121. In this version, the locking pin mechanism 121 operates in the reverse direction. That is, the locking pin 111A and the thumb release latch 116A are disposed in the swivel base 113A, while the blind hole 112A is located in the swivel body 110A. The ball detent mechanism 120 is substantially as described in connection with FIGS. 2, 3 and 4.

Figure 6:
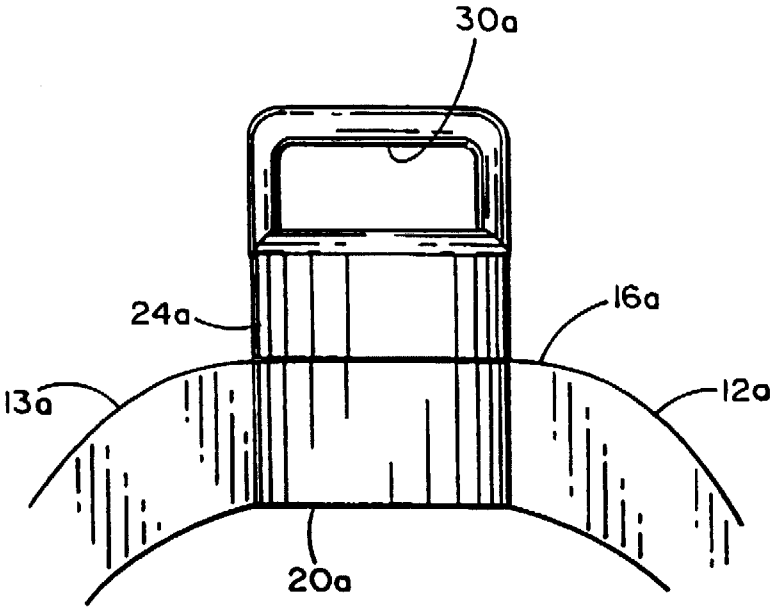
FIG. 6 is a fragmentary front view of yet another version of the stirrup iron of the present invention.
Figure 7:
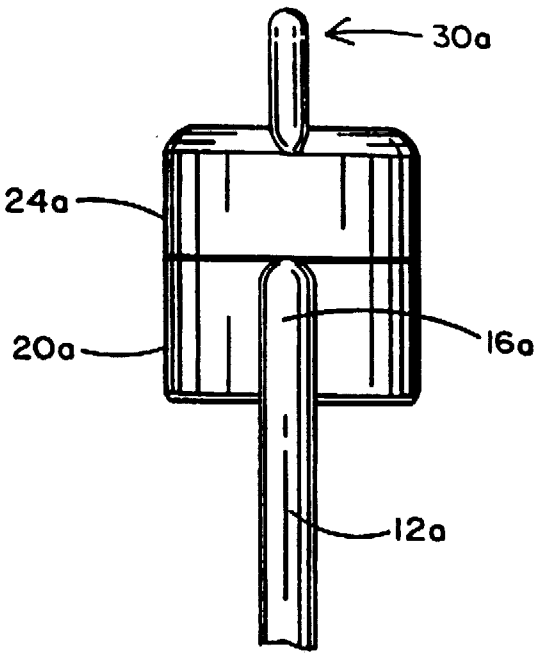
FIG. 7 is a fragmentary side view of the version of the stirrup iron of FIG. 6.

FIGS. 6 and 7 show yet another version of the stirrup iron of the present invention. FIG. 6 is a fragmentary front view of the stirrup iron, and FIG. 7 is a fragmentary side view of the stirrup iron of FIG. 6. To reduce the overall height, the swivel body 24A can be reduced in height. The stirrup leather opening 30A can also be reduced in height. Cumulatively, this results in a reduction of overall height. The swivel base 20A mounts across the top of the arch 16A. As shown, the swivel base 20A can be moved down into the top of the arch 16A to drop the silhouette of the stirrup iron. This can cumulatively reduce the height overall.

Figure 8:
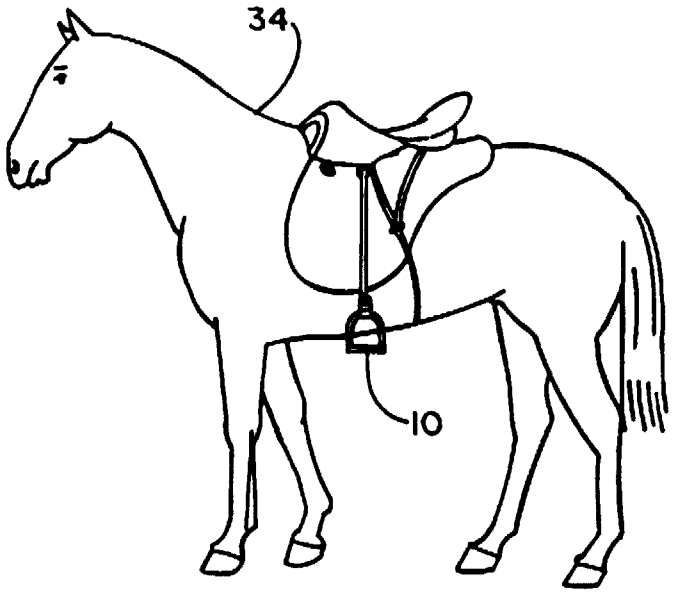
FIG. 8 is a view of a stirrup iron turned parallel to the side of the horse's body.
Figure 9:
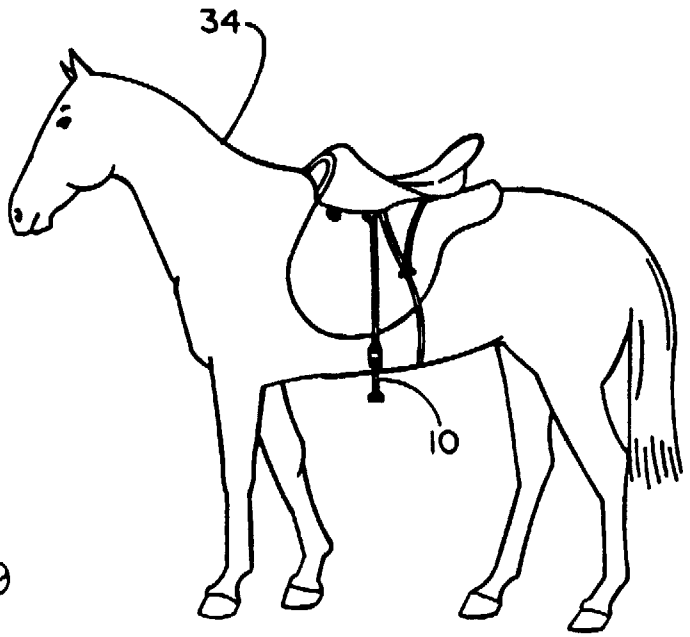
FIG. 9 is a view of a stirrup iron turned at an angle to the horse's body of more or less 90°.

When the rider is not mounted, he may wish to turn his stirrup irons 10 parallel to the side of the horse 34, as shown in FIG. 8. In this position, the stirrup iron 10 lies parallel to the body of the horse 34. If desired, the rider may slide the stirrup irons 10 up the stirrup leather 32 to the run up position (not shown). With the swivel construction of the present invention, the rider can turn the stirrup iron 10 so that it is accessible from the fore and aft direction, as seen in FIG. 9. In this position, the stirrup iron 10 is at an angle to the body of the horse 34 of more or less 90°. Then, should the rider lose his stirrup during riding, he can easily replace his foot therein. Thus, in accordance with the present invention, the stirrup iron 10 can be rotated with respect to the stirrup leather opening 30 to position the stirrup iron 10 in the most desirable position.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An equestrian stirrup iron comprising:

an arch member having first and second lower ends;

a foot bar connected to the first and second lower ends to create a foot support;

the arch member comprising an upper region; and a swivel assembly mounted to the upper region, said swivel assembly comprising:

a swivel body;

a stirrup leather member, extending upwardly from the swivel body, defining a stirrup leather opening;

a swivel base fixed to the upper region of the arch member and pivotally coupled to the swivel body for rotary movement relative to the swivel body about an upwardly extending axis;

detent means for providing a plurality of stable rotary orientations of the swivel body relative to the swivel base;

said detent means comprising a spring and a spring biasing detent element carried by a chosen one of the swivel base and swivel body, said detent element being biased towards a series of depressions formed in the other of the swivel base and swivel body by said spring; and said detent means comprising user-adjustable means for varying the force applied by said spring against said detent element.

2. Equestrian apparatus comprising:

a stirrup iron, said stirrup iron lying substantially in a plane, said stirrup iron having an opening therethrough at substantially a right angle to said plane, said opening being sufficiently large to receive the foot of an equestrian rider, the bottom of said opening being defined by a foot bar for engagement by the foot of an equestrian rider;

a stirrup leather member defining a stirrup leather opening and attached to said stirrup iron by a body, said stirrup leather opening being sized to receive a stirrup leather for support of said stirrup, said stirrup leather opening defining a stirrup leather plane, said stirrup leather plane lying a predetermined angle away from said stirrup iron plane so that when hanging freely, said stirrup iron is positioned so that it may be readily accessed by the foot of an equestrian rider;

said body being rotatably mounted with respect to said stirrup iron on a pivot for rotation about an axis;

a detent interengaged between said body and said stirrup iron, said detent releasably positioning said stirrup leather opening in preselected angular positions with respect to said stirrup iron; and said body having detent recesses therein and said stirrup iron having an engagement member for resiliently engaging in one of said recesses, said recesses being arranged at substantially a right angle around said axis so as to selectively detent said stirrup iron in its selected position.

3. Equestrian apparatus comprising:

a stirrup iron, said stirrup iron lying substantially in a plane, said stirrup iron having an opening therethrough at substantially a right angle to said plane, said opening being sufficiently large to receive the foot of an equestrian rider, the bottom of said opening being defined by a foot bar for engagement by the foot of an equestrian rider;

a stirrup leather member defining a stirrup leather opening and attached to said stirrup iron by a body, said stirrup leather opening being sized to receive a stirrup leather for support of said stirrup, said stirrup leather opening defining a stirrup leather plane, said stirrup leather plane lying a predetermined angle away from said stirrup iron plane so that when hanging freely, said stirrup iron is positioned so that it may be readily accessed by the foot of an equestrian rider;

said body being rotatably mounted with respect to said stirrup iron on a pivot for rotation about an axis;

a frictional member interengaged between said body and said stirrup iron to provide smoothly variable adjustment of said stirrup leather member with respect to said stirrup iron;

said body having an opening therethrough;

a headed bolt extending through said opening and engaging in said stirrup iron, said headed bolt having its head engaged on said body to retain said body with respect to said stirrup iron;

said body having detent recesses therein; and said stirrup iron having an engagement member for resiliently engaging in one of said recesses, said recesses being arranged at substantially a right angle around said axis so as to selectively detent said stirrup iron in its selected position.

4. Equestrian apparatus comprising:

a stirrup iron, said stirrup iron having an opening therethrough sized to receive the foot of an equestrian rider, said opening lying in a plane;

a stirrup leather member defining a stirrup leather opening and mounted on said stirrup iron by a body, said stirrup leather opening being configured to receive a stirrup leather to support said stirrup, said stirrup leather opening defining a plane, said plane of said stirrup leather opening lying at a predetermined number of degrees with respect to said plane of said stirrup iron;

a line of intersection of said planes of said stirrup leather opening and said stirrup iron defining an axis;

said stirrup leather opening being rotatable with respect to said stirrup iron on said axis;

said body and said stirrup iron interengaging on a pivot which lies on said axis;

said pivot having a cylindrical bearing surface thereon for rotation of said body with respect to said stirrup iron;

said body having an opening therethrough and said pivot being attached to said stirrup so that said body can rotate around said pivot;

said pivot having a head thereon, said head engaging on said body to retain said body on said pivot;

a detent between said body and said stirrup iron to releasably retain said stirrup iron with respect to said body at a selected angular position; and said detent comprising a detent ball resiliently engaged in one of a plurality of detent notches to releasably retain said stirrup iron at one of a selected plurality of rotatable positions with respect to said stirrup iron.

* * * * *